United States Patent [19]

Bowen et al.

[11] 4,455,093

[45] Jun. 19, 1984

[54] TIMER MECHANISM FOR RENTAL EQUIPMENT

[76] Inventors: Brenda R. Bowen, Rt. 3, Box 516, West Plains, Mo. 65775; Gaylon D. Griffin, 1933 Lynn St., West Plains, Mo. 65775

[21] Appl. No.: 411,507

[22] Filed: Aug. 25, 1982

[51] Int. Cl.[3] ..... G04B 47/00

[52] U.S. Cl. ..... 368/10; 368/97

[58] Field of Search ..... 368/10, 98–101, 368/97, 102, 103–106, 107, 108; 70/267–273

[56] References Cited

U.S. PATENT DOCUMENTS

| | | | |
|---|---|---|---|
| 2,415,911 | 2/1947 | Rybane | 70/273 |
| 2,679,302 | 5/1954 | Watson et al. | 368/97 |
| 3,390,519 | 7/1968 | Cooper | 368/101 |
| 4,205,520 | 6/1980 | Shackford | 368/10 |
| 4,287,964 | 9/1981 | Sollenberger | 368/97 |

FOREIGN PATENT DOCUMENTS

| | | | |
|---|---|---|---|
| 1138328 | 6/1957 | France | 70/267 |

*Primary Examiner*—Bernard Roskoski

*Attorney, Agent, or Firm*—Frank P. Cyr

[57] ABSTRACT

A controlling device adapted particularly for use with rental equipment wherein it is desired to control or limit the time of operation of the rented equipment. The unit comprises a spring-wound motor which will wind down upon expiration of the rental time and cause a switch to open to thus cause a cessation of operation of the rented equipment. A key is employed for effecting the rotation of one of a plurality of arms which will in turn actuate an arm extending from a counting mechanism which will indicate the amount of time the rented equipment has been previously paid for by the rentor of the equipment.

5 Claims, 5 Drawing Figures

TIMER MECHANISM FOR RENTAL EQUIPMENT

BACKGROUND OF THE INVENTION

There are many establishments which specialize in the rental of equipment such as vacuum cleaners, power tools, plumbing tools, floor sanders, polishers and the like. Such equipment is usually rented for use for a specified period of time for which a rental fee is paid for by the rentor of the equipment. Thus, if one wishes to rent a given piece of equipment for a specified period of time, the rental agency can, by employment of a key for the timer, set the rented equipment to operate for a given period of time and upon expiration of the set period of time, the equipment ceases to operate.

In the past, some attempts have been made to limit the amount of time for operation of a rented piece of equipment. Rental agencies have used a coin box associated with the rented equipment whereupon the rentor of the equipment places a coin in the coin box to thus permit the equipment to operate for a given period of time depending on the amount of coins deposited in the coin box. While such an arrangement will permit the rented equipment to continue operating for a desired period of time, such an arrangement is not considered efficient for a number of reasons. One such reason being that one may pilfer the coin box and thus deprive the owner of the equipment of the monies due for the rental. Another reason is that the person renting the equipment may not have the required denomination of coins to permit for the continued operation of the rented equipment.

With the above in mind, it is one object of the invention to provide a means whereby the rental agency for the equipment will be assured of proper payment for the time the equipment is rented.

Another object of this invention is to provide the rental agency with a proper key which will enable the agency to set the time of operation of the rented equipment and upon expiration of the time for which the equipment has been rented the timer must again be set by the agency to permit continued operation of the equipment.

Other and further objects and advantages of the invention will appear in the reading of the hereinbelow description; the invention consisting in the novel running-time meter and the novel features of operation, combination, construction and arrangement of parts illustrated in the accompanying drawing.

DESCRIPTION OF THE PREFERRED EMBODIMENTS

Figure 1:
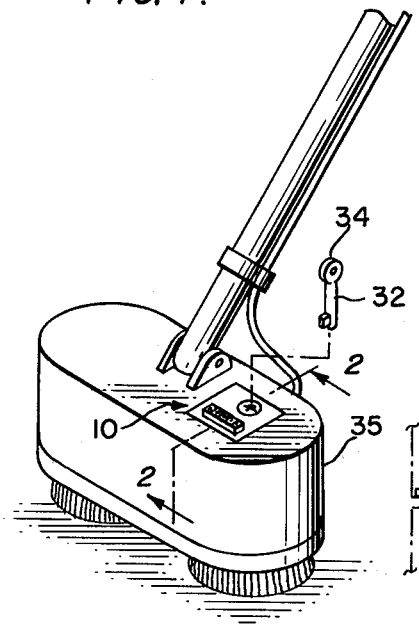
FIG. 1 is a perspective view of the timer of the present invention shown mounted on a floor polisher.

Referring now to the drawings wherein like reference numerals are employed to designate like parts throughout the several views, 10 designates in general, the timer of the present invention. The unit comprises a housing 11 having a top 12 integral with side walls 14 and a removable bottom wall 13. The housing may be constructed of metal or any other suitable material and while the housing is shown as being rectangular in shape, the same may be differently shaped to accommodate therein the components of the unit which will be fully described hereinafter.

Mounted within the housing is a support plate secured within the housing enclosure in any known manner as by screws 16 extending fronm suitable ears 17 secured in any known manner to the side walls 14 and a spring operated timer 18 is secured in any known manner to the support plate 15.

The timer 18 may be of conventional construction and is designed to open a switch 19 upon cessation of operation of the timer to thus render the rented equipment inoperative until the timer is again set in operation in a manner to be more fully described hereinafter.

A shaft 20 extends from the timer 18 and surrounding the shaft 20 is a coil spring 21 which extends between the top wall of the timer and a rotor 22 which encircles the shaft 20. Washers 23, 24 extend at either end of coil spring 21 so that when the timer is in operation the shaft 20 will be free to rotate without any interference from the spring. Mounted on the rotor 22 is a detent 25 and a plurality of arms 26 are secured in any known manner to the aforesaid rotor.

Mounted within the housing 11 is an indicator 27 of known construction having the usual indicating discs with denominations appearing on the peripheries of the discs. A counting arm 28 is pivotally mounted on the indicator 27 and is adapted to be contacted by one of the arms 26 mounted on the rotor 22.

An externally threaded key receiving member 29 extends through the top wall 12 of the housing and is secured thereto by means of lock nuts 30. The key receiver 29 is centrally bored as at 31 through which an operating key 32 extends. The key is partially hollow and encircles the shaft 20. A projection 33 is provided at one end of the key 32 and the opposite end of the key is provided with an operating handle 34.

As shown more clearly in FIG. 1 of the drawings, the housing 11 is adapted to be mounted within the casing 35, housing the components in the rented equipment by means of brackets 36 secured to the side walls 14 of the housing and which are adapted to cooperate with the like brackets (not shown) mounted within the casing 35 by means of bolts 37. Thus, with the top wall 12 formed integral with the side walls 14, access to the interior of the housing can only be had by removing the bottom wall 13 by removing the screws 38 which secure the bottom wall 13 to brackets 39 provided along the side walls 14.

Openings 40 are formed in side walls 14 through which extend the electrical wiring for operating the rented equipment and of course the switch 19 is interposed in the electrical wire so as to cut off the flow of electricity when the timer ceases to operate upon expiration of the time for which the timer has been set.

Figure 2:
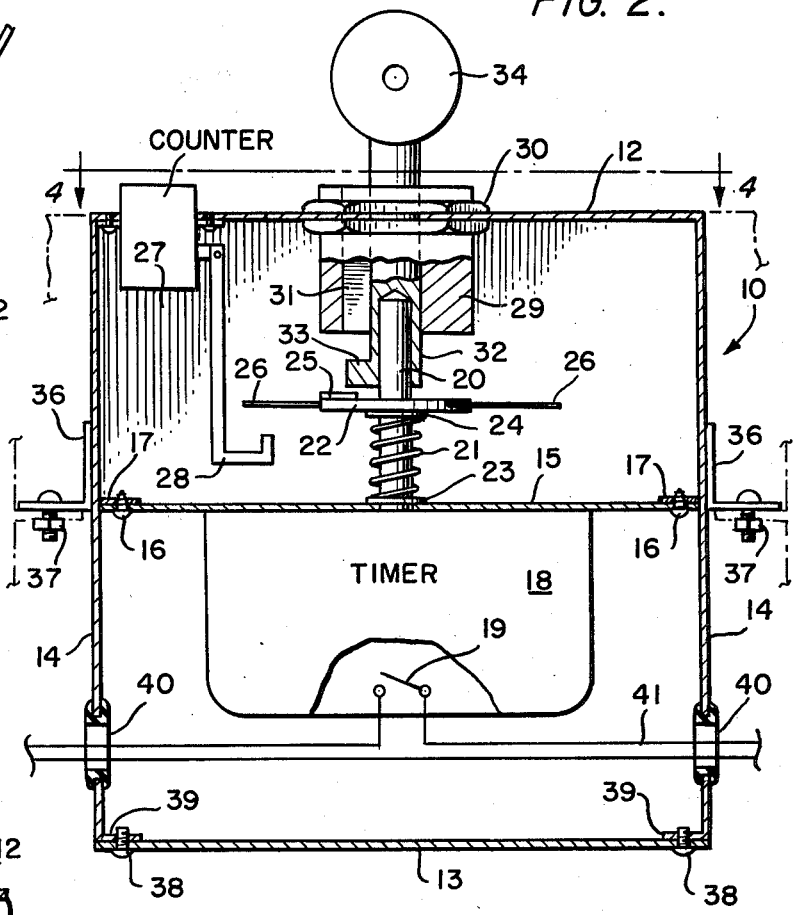
FIG. 2 is an enlarged view taken on lines 2—2 of FIG. 1, looking in the direction of the arrows.
Figure 3:
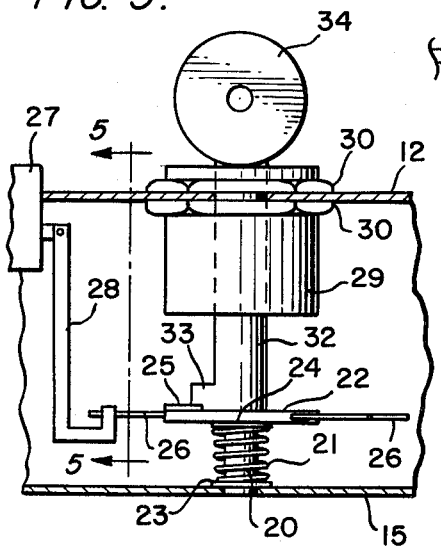
FIG. 3 is a fragmentary view taken on lines 3—3 of FIG. 2, looking in the direction of the arrows.
Figure 5:
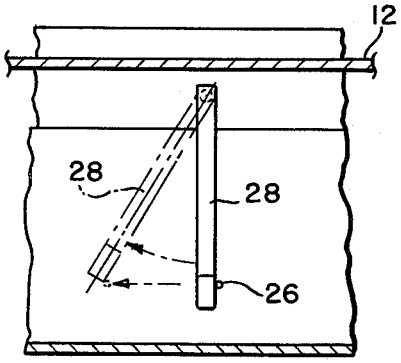
FIG. 5 is a section taken on lines 5—5 of FIG. 3, looking in the direction of the arrows, with parts broken away.

Operation of the unit is as follows:

The rental agency is informed of the amount of time the equipment is to be rented and thus inserts the key 32 into the bore of the key receiver 29 and upon depressing the key from the position shown in FIG. 2 to the position shown in FIG. 3, the rotor is depressed downwardly thereby compressing the spring 21. Upon rotating the key, the projection 33 will engage the detent 25 on rotor 22 to thus effect rotation of the rotor. Upon rotation of the rotor 22, one of the arms 26 mounted on the rotor will engage the counter arm 28 and cause the same to pivot as shown in FIG. 5 of the drawings, thus advancing one or more of the discs of the indicator to then permit the rental agency to determine the amount of operating time for the unit. Hour markings are provided on the top wall of the housing to indicate the time interval for which the rental equipment will be in operation. Upon cessation of the operating time for which payment has been made to the rental agency, the equipment must then be returned to the agency if additional operating time is desired.

Figure 4:
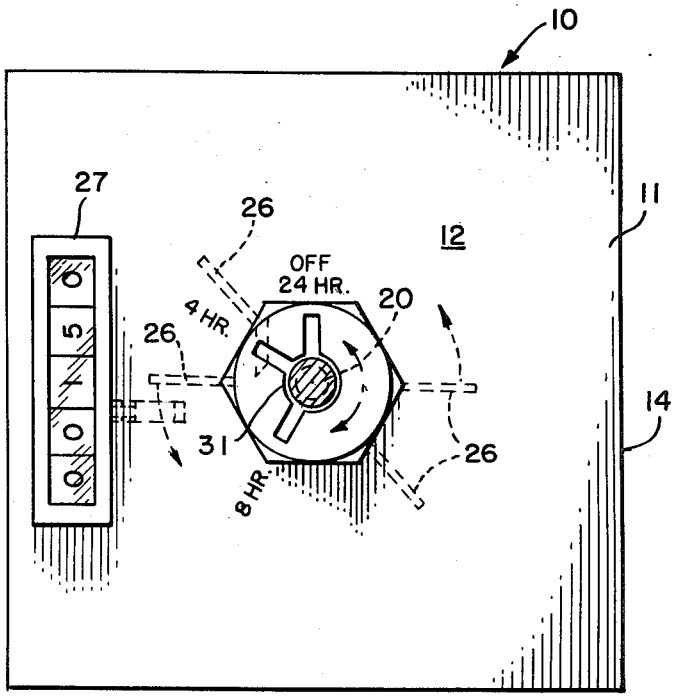
FIG. 4 is a top plan view of the timer.

For setting the time interval for which the timer has been set for operation, the key is turned clockwise as shown in FIGS. 2 and 4 of the drawings and the unwinding of the timer is set to rotate in a counter clockwise rotation.

From the foregoing, it will be seen that I have provided a simple yet efficient unit for assuring a rental agency to be fully compensated for the time period for which the rental equipment has been rented. Also, the unit is one which can be easily installed within the casing housing the components of the rented equipment and since access to the timer mechanism can only be had through the bottom of the casing upon removal of the bottom wall, attempts to alter the timer mechanism will be discouraged.

It will be seen that the objects set forth above among those made apparent from the preceeding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

I claim:

1. A timer mechanism for rental equipment comprising a housing for said timer mechanism, a support plate mounted in said housing, a spring operated timer mechanism mounted on said support plate, a shaft extending from said timer mechanism, a rotor mounted for rotation on said shaft, a plurality of arms mounted for rotation with said rotor, an indicator mounted in said housing, a counter arm mounted on said indicator, a partially hollow key adapted to extend over said shaft, said rotor traveling downwardly along said shaft upon application of a downward force on said key, said arms on said rotor engaging said counter arm on said indicator when said rotor is in a depressed position and upon rotation of said key, said indicator will indicate the time interval for which the equipment has been rented.

2. The structure recited in claim 1 wherein a spring means is interposed between said spring operated timer mechanism and said rotor.

3. The structure recited in claim 1 wherein said housing is mounted within the casing surrounding some of the components of the rental equipment.

4. The structure recited in claim 1 wherein a detent is provided on said rotor.

5. The structure recited in claim 4 wherein said key is provided with a projection for engaging with said detent when said rotor is in a depressed position.

* * * * *